United States Patent [19]

Hartshorn et al.

[11] 4,404,701

[45] Sep. 20, 1983

[54] SHOE SUPPORT

[75] Inventors: Frank Hartshorn, Wigston; Brian J. M. Murphy, Leicester; Richard E. Storer, Syston, all of England

[73] Assignee: USM Corporation, Farmington, Conn.

[21] Appl. No.: 341,531

[22] Filed: Jan. 22, 1982

[30] Foreign Application Priority Data

Feb. 20, 1981 [GB] United Kingdom ..... 8105496

[51] Int. Cl.[3] ..... A43D 3/00

[52] U.S. Cl. ..... 12/127

[58] Field of Search ..... 12/123, 126, 127

[56] References Cited

U.S. PATENT DOCUMENTS 2,954,571 10/1960 Baker ..... 12/127

3,311,936 4/1967 Leonhardt ..... 12/127

*Primary Examiner*—Patrick D. Lawson

*Attorney, Agent, or Firm*—Donald N. Halgren

[57] ABSTRACT

A shoe support comprises toe support means (34) and heel support means (30), the toe support means being mounted for adjusting movement relative to the heel support means in directions extending lengthwise, widthwise and heightwise of the bottom of a shoe supported by the shoe support. The heel support means (30) comprises a last pin (32') mounted for limited rocking movement abut an axis (412) extending lengthwise of the shoe bottom, the last pin being supported on a support member (420) which is angularly displaceable on a support rod (28), the arrangement being such that the rocking axis (412) of the last pin (32') can be adjusted angularly on the support rod, thus to locate said axis (412) substantially in the heel-to-toe plane of the shoe, as determined by the position of the toe support means (34). In this way, the shoe is supported in a more stable manner for operations to be performed thereon, e.g. a heel seat lasting operation.

7 Claims, 3 Drawing Figures

SHOE SUPPORT

BACKGROUND OF THE INVENTION (1) Field of the Invention

This invention is concerned with a shoe support for supporting a shoe comprising an upper and an insole carried on a last. The term "shoe" where used herein is used generically as indicating articles of outer footwear generally and as including an article of outer footwear in the course of its manufacture.

(2) Prior Art

Shoe supports have been proposed and used comprising toe support means and heel support means, the relative positions of said toe support means and heel support means being settable, according to the size and style of shoe, in directions extending both lengthwise and widthwise of the shoe bottom, wherein the heel support means comprises a last pin on which a last with an upper and insole carried thereon can be supported, bottom uppermost, and which is mounted on a support member for limited rocking movement about an axis extending lengthwise of the shoe bottom.

Shoe supports of the aforementioned type have been proposed for use in e.g. heel seat lasting machines, in which a problem has been found to arise, especially where lasting marginal portions of the upper are to be secured to corresponding marginal portions of the insole by means of metallic fasteners, e.g. tacks, in that the last pin, on which the shoe is supported, conventionally is accommodated in an appropriately positioned hole in the last cone, but such holes are often carelessly drilled with a result that either they are not arranged with their longitudinal axis normal to the cone surface, or they are not positioned centrally of the cone, or both. Thus, a fixed lasy pin may well serve to support the shoe with the bottom thereof misaligned in relation to the heel seat lasting instrumentalities. The rocking last pin overcomes this problem in that it enables the shoe bottom to be correctly oriented in relation to the plane of the heel seat lasting instrumentalities, regardless of the position of the last pin hole in the last cone.

In such a shoe support, however, the arrangement has usually been such that the rocking axis of the last pin is aligned with the longitudinal center line of the heel seat lasting instrumentalities. Where, however, the toe end of the shoe bottom is significantly offset from the longitudinal center line of the heel end portion of the shoe bottom, and thus the toe support means of the shoe support is significantly offset from the longitudinal center line of the machine, the support for the shoe may become unstable. This instability is believed to arise primarily because of the lack of symmetry of the last about its heel-to-toe plane, in combination with the bulk of the material of the last being disposed about the rocking axis of the last pin, with the result that the last pin is urged by the bulk of the last to rock about its axis, this rocking being such that the less bulky portion of the last, on the opposite side of the heel-to-toe plane, tends to lift off the toe support means. At the same time, rocking of the last in an opposite direction, which may be desirable in order to orient correctly the shoe bottom in the plane of the heel seat lasting instrumentalities, is strongly opposed because of the relationship between the rocking axis of the last pin and the heel-to-toe plane of the last.

It is therefore the object of the present invention to provide an improved shoe support of the type referred to above, in the use of which the shoe is supported in a more stable manner, while at the same time enabling the shoe to be oriented as desired to operating instrumentalities of a machine for operating on the shoe, regardless of the shoe bottom contour.

The invention thus provides a shoe support for supporting a shoe comprising an upper and an insole carried on a last, said support comprising toe support means and heel support means, the relative positions of said toe support means and heel support means being settable, according to the size and style of shoe, in directions extending both lengthwise and widthwise of the shoe bottom, wherein the heel support means comprises a last pin on which a last with an upper and insole carried thereon can be supported, bottom uppermost, and which is mounted on a support member for limited rocking movement about an axis extending lengthwise of the shoe bottom, the support member being itself mounted for movement about an axis extending heightwise of the shoe bottom whereby the support member can be positioned with the rocking axis of the last pin substantially in the heel-to-toe plane of the shoe supported by the shoe support.

By thus aligning the rocking axis of the last pin in the heel-to-toe plane of the shoe, the tendency of the shoe to rock in an undesirable manner as above described is resisted, while limited rocking in both directions about the rocking axis, for purposes of orienting the shoe bottom to operating instrumentalities, is permitted.

For positioning the support member as aforesaid, locating means may be provided, comprising a locating pin engageable in one or more recesses provided therefor. The locating pin may be inserted by the operator after he has positioned the support member in a desired position. Alternatively, the locating pin may comprise a spring-urged detent, which yields as the operator rotates the support member. Furthermore, clamp means may be provided by which the support member can be clamped when it has been positioned as aforesaid.

The mounting for the last pin conveniently comprises a cradle in which a block supporting the last pin is mounted for limited rocking movement, and the cradle being mounted in a support block carried by the support member, and being slideable in relation to said support block in a direction extending widthwise of the shoe bottom, locking means being provided for securing the cradle in adjusted widthwise position. Such setting of the cradle, widthwise of the shoe bottom, provides compensation for the difference, widthwise of the shoe bottom, between the longitudinal center line of the cone surface of the last and the longitudinal center line of the heel seat of the shoe bottom.

In addition, the support block and support member preferably have complementarily shaped inter-engaging faces, the center of curvature of which extends widthwise of the shoe bottom, the support block being slideable relative to the support member about said center of curvature, and locking means being provided for securing the support block in adjusted position on said member. Such adjustment enables different styles of shoe to be accommodated, more especially according to the heel height thereof.

The locking means for securing the support block as aforesaid conveniently comprises two adjustable stop members engageable with the abutment means, said members and means being associated one with the support block and the other with the support member, the stop members serving also to enable the position in which the support block is clamped thereby to be adjusted.

In order adequately to support the last on the last pin, furthermore, preferably a last support plate is provided, to be engaged by the cone surface of the last supported by the last pin, the under-side of said plate having a part-spherical recess co-operating with a complementarily shaped surface of the block supporting the last pin and being resiliently secured on said block. Thus, regardless of the orientation of the last on the last support, an overall surface contact can be achieved between the shoe-engaging surface of the last support plate and the corresponding last cone surface.

BRIEF DESCRIPTION OF THE DRAWINGS

There now follows a detailed description, to be read with reference to the accompanying drawings, of one shoe support in accordance with the invention, which support has been selected for description merely by way of exemplification of the invention and not by way of limitation thereof.

In the accompanying drawings.

DESCRIPTION OF THE PREFERRED EMBODIMENTS

The shoe support in accordance with the invention may form part of an apparatus for use in the manufacture of shoes, as described in the Specification of our co-pending U.K. patent application No. 8,102,297, in which a shoe is placed on the shoe support at a loading station and is carried from said station to a plurality of operating stations at which side lasting and seat lasting operations are effected. In such apparatus, a plurality of shoe supports are used, mounted on a common turret arrangement.

Figure 1:
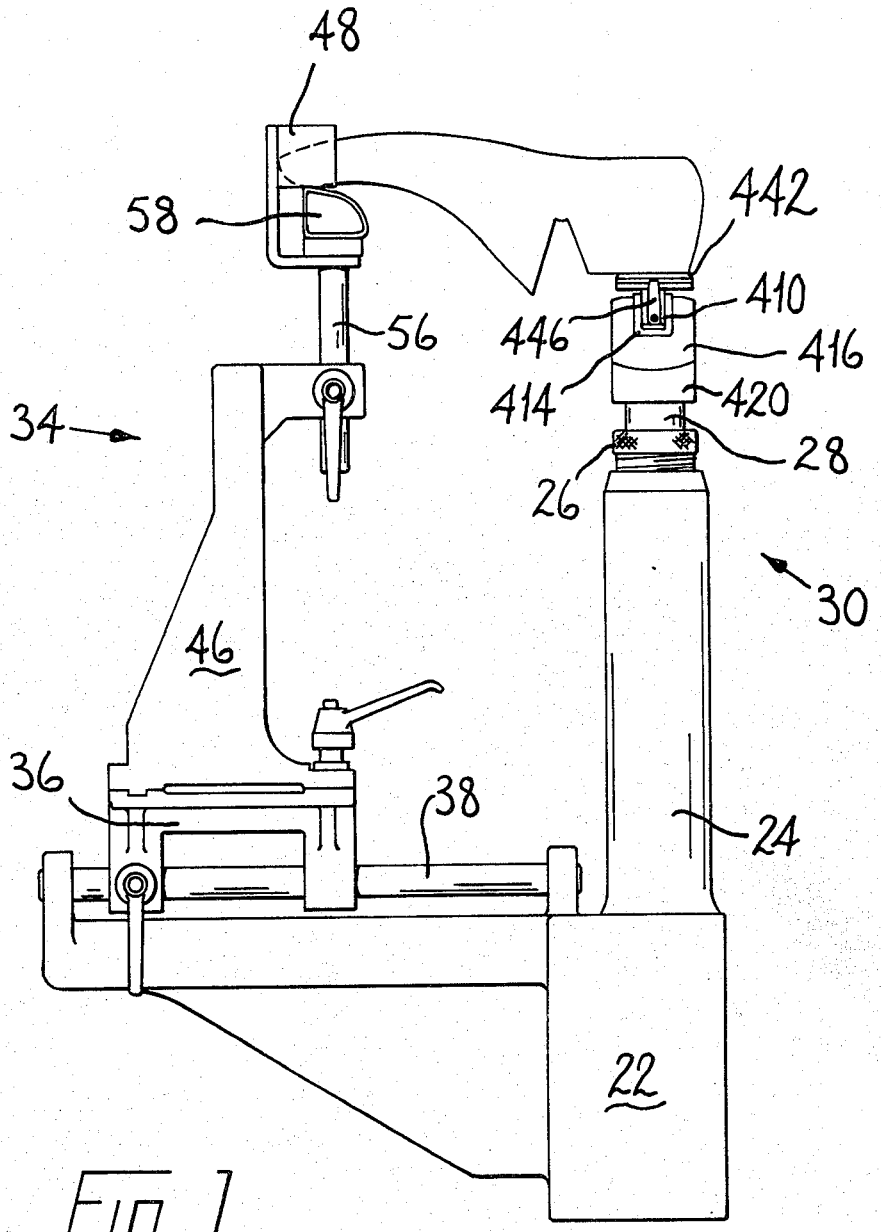
FIG. 1 is a general side view of a shoe support in accordance with the invention, showing toe support means and heel support means thereof.

The shoe support in accordance with the invention comprises toe support means generally designated 34 and heel support means generally designated 30, as shown in FIG. 1. The toe support means 34 may be of any conventional design and comprises a V-shaped toe end engaging member 48 and a toe pad 58, the arrangement being such that the pad 58 supports a toe cap portion of a shoe the toe end of which is positioned by the V-shaped member 48. For supporting the member 48 and pad 58, the support means 34 comprises a block 36 mounted on two rods 38 for movement towards and away from the heel support means 30, the block 36 having a transverse groove in which an upstanding support member 46 is accommodated for widthwise sliding movement, so that the toe support means can be set for a left or a right shoe, and the member 48 and pad 58 being mounted on the support member 46, by means of an upstanding rod 56, for heightwise movement. Thus, the position of the member 48 and pad 58 in relation to the heel support means can be varied in directions extending lengthwise, widthwise and heightwise of the bottom of a shoe supported by the shoe support, suitable locking means being provided.

Figure 2:
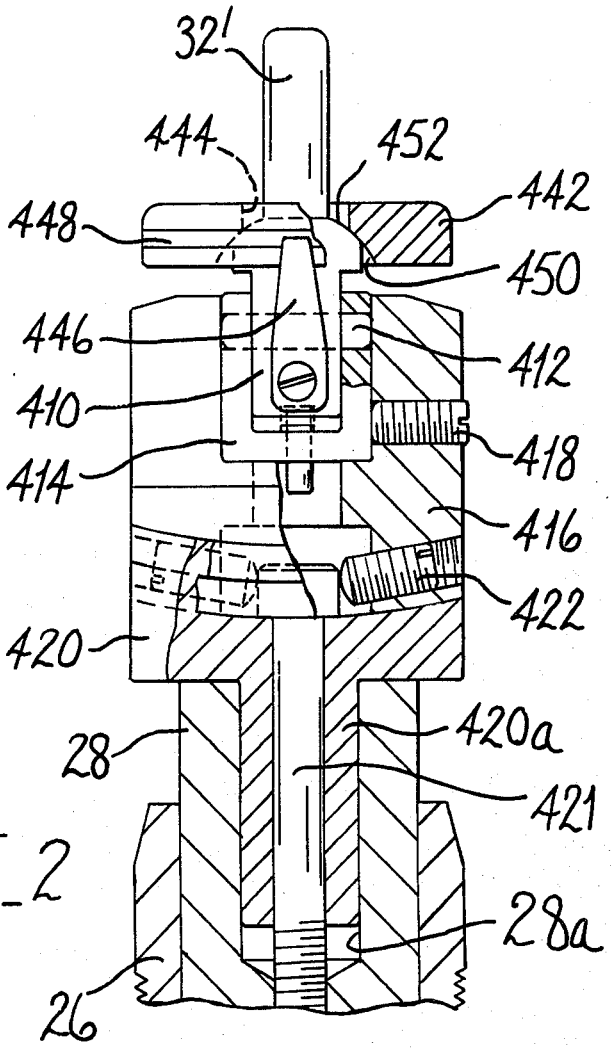
FIG. 2 is a fragmentary view, partly in section, showing details of the heel support means shown in FIG. 1.

The heel support means 30 of the shoe support in accordance with the invention comprises a mounting 22 having an upstanding sleeve portion 24, an upper end of which has an adjustable threaded collar portion 26. Projecting from the collar portion 26, and slideable heightwise therein, is a rod 28 carrying a support member 420 having a downwardly depending spigot portion **420*a* accommodated in a bore 28*a* provided therefor in the rod 28, shown in FIG. 2. The support member 420 is thus able to be rotated, about the axis of its spigot, and thus about an axis extending heightwise of the shoe bottom, clamping means, in the form of a headed bolt 421, being provided for clamping the support member 420 in adjusted position on the rod 28. The support member 420 has a groove portion in which is accommodated a support block 416, inter-engaging faces of the block 416 and support member 420 being curved, and the center of curvature thereof extending widthwise of the shoe bottom, the block 416 thus being able to slide relative to the support member 420 about said center of curvature, thus to set the toe-and-heel orientation of the shoe. For locating the block 416 in position in the groove of the support member 420, and also for clamping it in adjusted position, two locating pins 422 are provided, threadedly secured in the block 416 and engageable each with the head of the clamp bolt 421. The support block 416 in turn is provided with a groove, normal to the groove of the support member 420, for receiving a cradle 414 for sliding movement therein, a locking pin 418 being provided, in the support block 416, for locking the cradle 414 in adjusted position. The position of the cradle 414 can thus be set by the operator in a direction extending widthwise of the shoe bottom. The cradle 414, which is generally U-shaped in end view, supports a pivot pin 412 on which is carried a block 410, itself supporting a last pin 32', the pin 32' thus being able to rock about the axis of the pin 412 (which axis thus constitutes the rocking axis of the last pin). The rocking capability of the pin 32'** enables lasts to be properly located on the shoe support, despite any irregularities in the location and/or angle of the last pin hole provided in the last cone.

For supporting each last, furthermore, the heel support means 30 also comprises a support plate 442, on which the cone surface of the last rests when a last is placed on the last pin 32'. The support plate 442 has an elongated slot 444 through which the last pin 32' projects, and spring fingers 446 are bolted to opposite sides of the block 410 and engage in grooves 448 formed at opposite sides of the plate 442, to hold it resiliently in position on the block. The underside of the plate 442, furthermore, has a part-spherical recess 450 which engages on a complementarily shaped surface 452 of the block 410, so as to enable the plate to be universally movable relative to the last pin 32'. In this way, overall surface engagement can be achieved between the plates 442 and the cone surface of the last.

For positioning the support member 420, and thus the rocking axis 412 of the last 32' in a desired angular relationship with the rod 28, and thus also with the toe support means 34, aligned bores (not shown) may be provided in the support member 420 and rod 28, in which bores a locating pin may be accommodated. Where more than one angular orientation is desired for the support member 422, furthermore, it is merely necessary to provide a plurality of such bores either in the support member 420, or in the rod 28, or indeed in both. Alternatively, and this will be especially the case where it is desired frequently to change the angular relationship of the support member 420 and the rod 28, a detent-and-recess arrangement may be provided in the inter-engaging surfaces of the support member and rod. In this later case, furthermore, preferably a quick-release clamping arrangement is provided to replace the clamping bolt 421. Again, alternatively, the support member 420 may be connected to the toe support means 34, so that a widthwise adjustment of the position of the toe support means will also be effective to vary the angular relationship of the support member 420 about the rod 28.

In using the shoe support in accordance with the invention, e.g. in a machine for lasting heel seat portions of shoes, the rocking axis 412 of the last pin 32' will not now be aligned necessarily with the longitudinal center line of the heel seat lasting instrumentalities of such machine, but rather will be positioned to lie substantially in the heel-to-toe plane of the shoe bottom, which plane is of course determined by the widthwise position of the V-shaped toe end engaging member 48. Of course, in certain circumstances, the rocking axis of the last pin may well lie along the longitudinal center line of the heel seat lasting instrumentalities, viz. when the shoe bottom shape is such that the V-shaped member 48 is located on said center line also. It will of course be appreciated that some misalignment between the heel-to-toe plane of the shoe bottom and the rocking axis 412 of the last pin 32' can be tolerated without going beyond the scope of the present invention.

Figure 3:
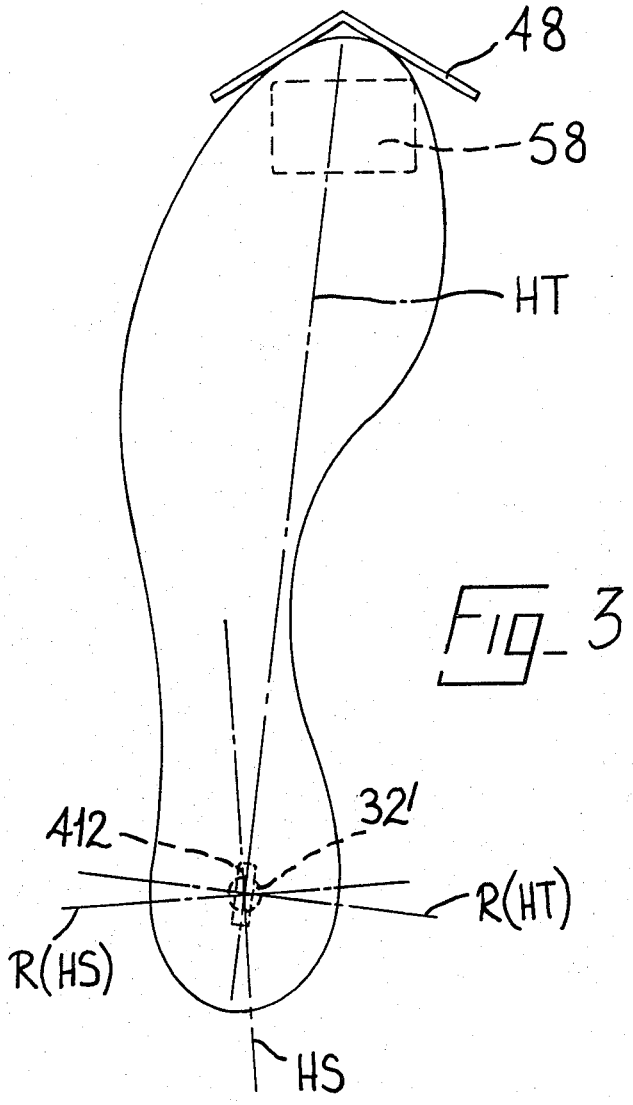
FIG. 3 is a diagram of a shoe bottom, indicating the heel-to-toe plane thereof in relation to a rocking axis of a last pin of the heel support means.

FIG. 3 is a diagram of a shoe bottom, showing the heel-to-toe plane HT of the last bottom, the location of which is determined by the widthwise setting of the toe support means 34 (indicated in this Figure by the member 48 and pad 58). The longitudinal center line of the heel seat (HS) is also indicated. Conventionally, using e.g. a heel seat lasting machine, the rocking axis 412 of the heel pin 32' would be aligned with the line HS, so that the last pin would be able to rock in a plane indicated by R(HS). With a shoe having a configuration as indicated in FIG. 3, however, there would be a tendency for the last to tilt on its support. Thus, in accordance with the invention, the rocking axis 412 is aligned with the heel-to-toe plane HT, the rocking plane now being as indicated by R(HT). Such an arrangement has been found to militate against undesired tilting of the last, while allowing the last to be oriented in a desired relationship with the operating instrumentalities of the machine.

We claim:

1. A shoe support for supporting a shoe comprising an upper and an insole carried on a last, said support comprising:

a toe support means and a heel support means, the relative positions of said toe support means and heel support means being settable, according to the size and style of shoe, in directions extending both lengthwise and widthwise of the shoe bottom, wherein the heel support means comprises a last pin on which a last with an upper and insole carried thereon can be supported, bottom uppermost, and which is mounted on a support member for limited rocking movement about an axis extending lengthwise of the shoe bottom, the support member being itself mounted for movement about an axis extending heightwise of the shoe bottom whereby the support member can be positioned with the rocking axis of the last pin substantially in the heel-to-toe plane of the shoe supported by the shoe support.

2. A shoe support according to claim 1 wherein, for positioning the support member as aforesaid, locking means is provided, comprising a locating pin engageable in one or more recesses provided therefor.

3. A shoe support according to claim 2 wherein clamping means is provided by which the support member can be clamped when it has been positioned as aforesaid.

4. A shoe support according to claim 3 wherein the mounting for the last pin comprises a cradle in which a block supporting the last pin is mounted for limited rocking movement, the cradle being mounted in a support block carried by the support member, and being slideable in relation to said support block in a direction extending widthwise of the shoe bottom, locking means being provided for securing the cradle in adjusted widthwise position.

5. A shoe support according to claim 4 wherein the support block and support member have complementarily shaped inter-engaging faces, the center of curvature of which extends widthwise of the shoe bottom, the support block being slideable relative to the support member about said center of curvature, and locking means being provided for securing the support block in adjusted position on said member.

6. A shoe support according to claim 5 wherein the locking means comprises two adjustable stop members engageable with abutment means, said members and means being associated one with the support block and the other with the support member, the stop members serving also to enable the position in which the support block is clamped thereby to be adjusted.

7. A shoe support according to claim 6 wherein a last support plate is provided, to be engaged by the cone surface of the last supported by the last pin, the underside of said plate having a part-spherical recess cooperating with a complementarily shaped surface of the block supporting the last pin and being resiliently secured on said block.

* * * * *